United States Patent [19]

Franke

[11] Patent Number: 4,639,405

[45] Date of Patent: Jan. 27, 1987

[54] METHOD AND APPARATUS FOR FIXING TONER IMAGES

[75] Inventor: Hans G. Franke, Rochester, N.Y.

[73] Assignee: Eastman Kodak Company, Rochester, N.Y.

[21] Appl. No.: 781,363

[22] Filed: Sep. 30, 1985

[51] Int. Cl.[4] ..... G03G 13/20; G03G 15/20

[52] U.S. Cl. ..... 430/124; 430/99; 355/3 FU; 432/59; 432/60; 219/216

[58] Field of Search ..... 430/99, 124; 219/216; 432/60, 59; 355/3 FU, 14 FU

[56] References Cited

U.S. PATENT DOCUMENTS

| | | | |
|---|---|---|---|
| B 493,501 | 2/1976 | Root | 355/3 DD X |
| 3,717,747 | 2/1973 | Fuyuki | 219/216 |
| 3,740,867 | 6/1973 | Hamaguchi | 432/59 X |
| 3,982,094 | 9/1976 | Kratcoski et al. | 219/216 |
| 4,163,892 | 8/1979 | Komatsu et al. | 219/216 |
| 4,223,203 | 9/1980 | Elter | 219/216 |
| 4,427,285 | 1/1984 | Stange | 355/3 FU |
| 4,537,492 | 8/1985 | Lein et al. | 432/59 X |
| 4,538,899 | 9/1985 | Landa et al. | 355/3 FU X |

FOREIGN PATENT DOCUMENTS

| | | | |
|---|---|---|---|
| 82/3001 | 12/1971 | Japan . | |
| 52-4842 | 1/1977 | Japan | 355/3 FU |
| 56-104364 | 8/1981 | Japan | 355/3 FU |
| 58-107548 | 6/1983 | Japan | 430/99 |

*Primary Examiner*—Roland E. Martin

*Attorney, Agent, or Firm*—Herman J. Strnisha

[57] ABSTRACT

This invention relates to a method and apparatus for fixing toner images in which a copy sheet bearing unfixed toner is first passed through a pair of heated fuser rollers and is subsequently passed through surfacing rollers to provide a gloss to the toner image. In order to prevent curling of the copy sheet and blistering of the glossed image, the copy sheet is passed through a conditioner means, located between the fuser rollers and the surfacing rollers, for removing a substantial portion of the moisture from the copy sheet.

13 Claims, 2 Drawing Figures

METHOD AND APPARATUS FOR FIXING TONER IMAGES

BACKGROUND OF THE INVENTION

This invention relates generally to the field of electrostatography, and more particularly, the invention relates to a method and apparatus for fixing toner images to a support by means of heat and pressure.

In an electrostatographic process, an image formed by fusible toner particles is transferred to a support such as a copy sheet. The toner image is permanently fixed to the support by passing the support through a fuser. In one such fuser, the support is passed between a pair of opposed rollers, one roller being a heated fuser roller and the other roller being a non-heated pressure roller.

Fused toner images normally exhibit a dull or matte surface. In certain types of images, particularly colored toner images, it is desirable for the image to have a surface gloss. One example of apparatus for fusing colored images is shown in U.S. Pat. No. 4,223,203. In this patent, there is disclosed fusing apparatus for fixing toner images to copy substrates comprising a first pair of rolls, one of which is provided with a conformable outer surface, and a second pair of rolls, one of which has a rigid outer surface. Copy sheets are passed sequentially through the first and second pairs of rolls, the first pair serving as a fuser means and the second pair as a glossing means. There is a problem in using such apparatus under certain operating conditions, for example, when coated paper is used, in that the prints tend to show blistering and curling after the fusing process.

SUMMARY OF THE INVENTION

It is an object of the present invention to overcome the above-described problem in the prior art and to provide a method and apparatus for fixing toner images in which a high-quality glossy print is produced.

In accordance with the present invention, there is provided apparatus for fixing toner images to copy sheets, said apparatus comprising fuser means for fixing a toner image on a copy sheet, conditioner means for removing moisture from said copy sheet, and surfacing means for providing a gloss to a toner image fixed on a copy sheet.

In accordance with the present invention, there is also provided a method of fixing a toner image on a copy sheet, said method comprising the steps of removing from about 50% to about 80% of the moisture content of a copy sheet bearing a toner image, and passing said copy sheet through surfacing means to fix the toner image on the copy sheet and provide a gloss to the toner image.

In one embodiment of the present invention, a copy sheet bearing an unfixed toner image is first passed through a pair of opposed fuser rollers and is then moved onto a conveyor which transports the copy sheet through a conditioner means in which a substantial portion of the moisture is removed from the copy sheet; the conveyor delivers the copy sheet to an opposed pair of surfacing rollers which impart a surface gloss to the image.

The present invention produces prints, especially multicolor prints, which exhibit a high-quality glossy surface; there is an enhancement in both the optical reflection density and color saturation. An important feature of the present invention is that the fusing and finishing improvements are accomplished without any deleterious effects such as paper curl or blistering. The disclosed method and apparatus can be used to fix toner images on copy sheets in a simplex mode (image on one side of the sheet) and in a duplex mode (image on both sides of the sheet).

Other features and advantages will become apparent upon reference to the following description of the preferred embodiment when read in light of the attached drawings.

DESCRIPTION OF THE PREFERRED EMBODIMENT

The present invention is adapted to be used in electrophotographic apparatus such as that shown and described in commonly-assigned U.S. Pat. No. 3,914,047. As disclosed therein, an endless photoconductive member is moved past a series of work stations. At the start of a copy cycle, the photoconductive member receives an electrostatic charge at a charging station. A light image of a document is then projected onto the charged photoconductive member at an exposure station to form a latent electrostatic image. The electrostatic image is developed with toner to produce a toner image which is subsequently transferred to a copy sheet brought into contact with the photoconductive member at a transfer station. The copy sheet carrying the unfused toner image is separated from the photoconductive member and passed through a pair of fuser rollers to permanently fuse the toner image to the copy sheet.

The term "gloss" in the present application refers to a surface luster or brightness; "luster" can be defined as a glow of reflected light. "Luminance factor" refers to the ratio of the luminance of the measured surface to the luminance of a perfectly diffusing surface under identical conditions. The luminance factor is used herein as an indication of gloss level, the higher the luminance factor, the higher the gloss level or the degree of gloss.

Figure 1:
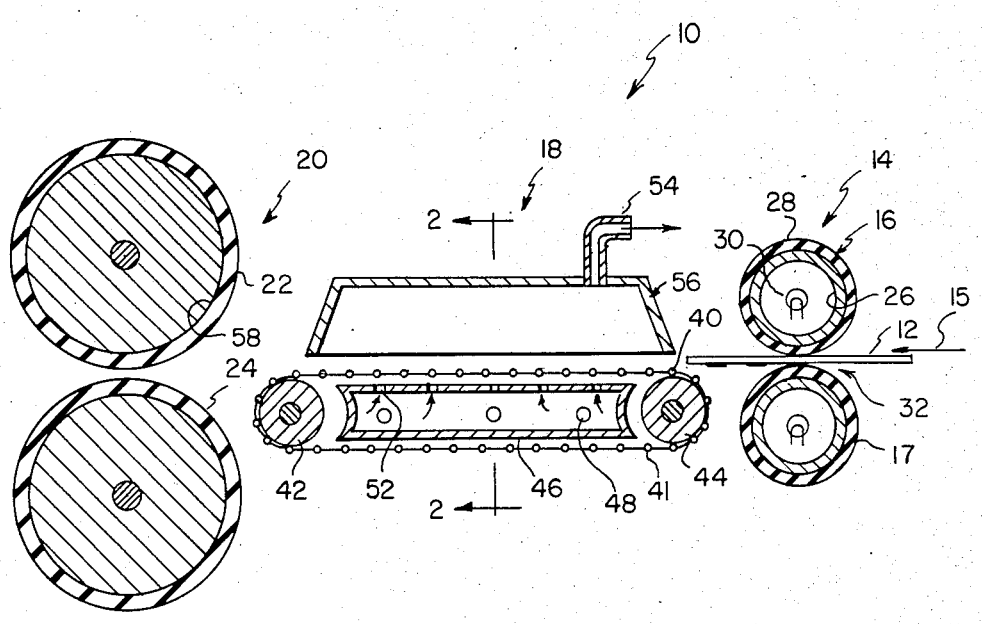
FIG. 1 is an elevational view, partially in section, showing the apparatus of the present invention.
Figure 2:
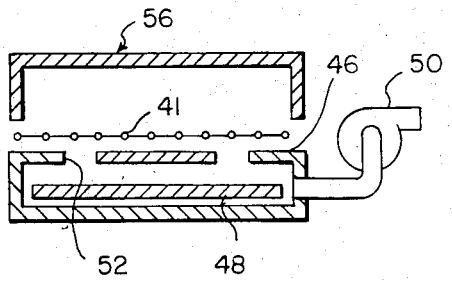
FIG. 2 is a sectional view, taken along the line 2—2 in FIG. 1.

With reference to FIG. 1, there is shown apparatus 10 for fixing a toner image on a copy sheet 12 which can be, for example, a fibrous paper support. Toners which can be used with apparatus 10 include pigmented thermoplastic toners. Copy sheet 12 moves through apparatus 10 in the direction of arrow 15 and is first passed through a fuser means 14 which includes an upper fuser roller 16 and a lower fuser roller 17. Copy sheet 12 exits from fuser means 14 into a conditioner means 18, and the conditioner means 18 delivers sheet 12 to a surfacing means 20 which includes an upper surfacing roller 22 and a lower surfacing roller 24.

Upper fuser roller 16 and lower fuser roller 17 are identical in the preferred embodiment, and thus, only roller 16 will be described. Roller 16 comprises an inner cylinder 26 which is made from a good conductive metal, and an elastomeric coating 28 formed on the cylinder 26. A cylindrical infrared lamp 30, located generally at the center of fuser roller 16, provides heat for roller 16. Roller 16 can be, for example, approximately three inches in diameter and lamp 30 can be a 1,250-watt lamp. Rollers 16 and 17 are biased toward each other with a pressure of, for example, 18 pounds per linear inch (pli), by a biasing means (not shown).

Rollers 16 and 17 can be operated at a temperature of, for example, 300° F. Rollers 16 and 17 form a nip 32 where the two rollers 16, 17, come together, and copy sheet 12 passes through the nip 32, as shown in FIG. 1. If pressure and temperature are not properly controlled at the exit of the nip 32, some toner may adhere to the fuser rollers 16, 17, rather than to copy sheet 12. To counteract this tendency, a silicon oil can be applied to each of the rollers 16, 17, to aid in toner release.

As copy sheet 12 emerges from rollers 16 and 17, the sheet 12 is moved onto a conveyor 40 in conditioner means 18. Conveyor 40 comprises an endless belt 41 formed of a wire screen; belt 41 is trained about a roller 42 driven by a motor (not shown), and an idler roller 44. Conditioner means 18 also includes a housing 46 having heater elements 48 therein, and a blower 50 connected to the housing 46. Air from blower 50 is circulated over heater elements 48; and the air heated by elements 48 passes through openings 52, in housing 46, through belt 41 and is exhausted through a vent 54 in a hood 56. Thus, a copy sheet 12 being transported on belt 41 will be heated by the air passing through openings 52, and moisture will be removed from the copy sheet as it is moved into surfacing means 20.

The conditioning means 18 must be capable of transport velocities equal to the surface speeds of the fuser means 14 and the surfacing means 20, and it is designed for optimum heat transfer to the copy sheet 12 for the removal of moisture therefrom. The rate of water removal must be accomplished at a carefully controlled rate to avoid blistering or curling of the copy sheet 12. The rate of moisture removal is controlled such that the pressure drop across the paper does not exceed the bond strength. Under certain operating conditions, dictated by the particular toner used, type of copy sheet 12, etc., freedom from blistering occurs when the moisture level in the copy sheet is reduced to within about 20 to about 30% of its original moisture content at room temperature; and the minimum time to remove water from a copy sheet 12 without producing blistering is about one second when the copy sheet 12 is, for example, a paper sold under the trademark Vintage Velvet. Although a straight, horizontal path for copy sheet 12 is shown in FIG. 1, a vertical path or a curved path can also be used.

Surfacing means 20 is adapted to subject a copy sheet 12 to a moderate and uniform pressure at elevated temperatures. Under these conditions, the toner image is additionally fused, but the primary purpose of surfacing means 20 is to cause the toner to flow stress-free and to conform to the smoothness of the surfacing rolls to provide the desired image gloss. It is important that blistering on the copy sheet should not be induced during this phase and that surfacing-induced artifacts should be minimized.

Surfacing roller 22, which can be identical to roller 24, has a covering 58 which can be formed from a variety of materials. Useful results have been obtained with a covering 58 of (1) 0.005 inch sprayed EC 4952 rubber, a silicone rubber made by Emerson and Cuming Corp., over 0.2 inch ground EC 4952, or (2) 0.003 inch sprayed E-60, a copoly(vinylidene fluoride-hexafluoropropylene), sold under the trademark Viton by Dupont Co., over 0.2 inch ground EC 4952, or (3) 0.001 inch dip coated addition-curable polydimethyl siloxane, sold under the trademark Tufel by General Electric Co., over 0.2 inch ground EC 4952. Alternatively, useful surfacing may be obtained by making one of the rollers 22, 24, a metal roller with no added resin coating.

The following examples are presented to better illustrate the successful practice of the invention.

EXAMPLE 1

Composite apparatus used in this example included a two-roller fuser, a conditioner means which included a conveyor and an infrared lamp for heating a copy sheet thereon, and a pair of heated surfacing rollers. Two different toners were used for comparing results of the composite apparatus with results from using only the two-roller fuser. One of the toners used was a crosslinked styrene-acrylic toner, and the other toner was a non-crosslinked styrene acrylic toner; both of these toners are described in U.S. Pat. No. 3,938,992. Gloss measurements (Dmax areas) are summarized in Table 1.

TABLE 1

| Toner | Two-Roller Fuser | Composite Apparatus |
|---|---|---|
| Crosslinked styrene-acrylic slight toner | Matte - (0.24)* | Matte - (0.47) gloss |
| Non-crosslinked styrene-acrylic toner | Matte - (0.18) | (24.0)** High gloss |

*Numerical values indicate luminance factor.
**The gloss, at this luminance factor, was judged subjectively to approach that of a ferrotyped finish.

EXAMPLE 2

Composite apparatus, as described in Example 1, was used in which the fuser rollers and surfacing rollers were operated at surface speeds of about 10–15 inches/-second. Multicolor prints were desiccated by stopping the print in the conditioner means for 15 seconds at an ambient temperature of about 250°–350° F. (120°–175° C.) to permit heat transfer to the paper support and thereby "condition" it by removal of moisture therefrom. The experimental data indicated that the moisture content of the paper support acts as a prime limiting factor to high-speed surfacing, i.e., achieving a high gloss print within practical conditions.

EXAMPLE 3

In this experiment, the operation of a two-stage fuser/finisher with a conditioner means before the surfacing rollers was compared with the operation of a two-stage fuser/finisher without a conditioner means. Multicolor prints from the apparatus were observed for paper blistering thresholds. The conditioner means included a belt conveyor and forced hot air. Humidity was controlled by the use of a humidity chamber manufactured by the Tenny Corp., South Brunswick, N.J. It was shown that relative humidity affects (1) the surfacing rate of the print and (2) the propensity of the paper print to blister. The apparatus was operated at a paper speed of 15 inches per second, the paper was Vintage Velvet paper, the toners used were those indicated in Example 1, and the surfacing rollers were operated at a pressure of 70 psi and a surface temperature of 340/325° F. The results obtained are listed in Table 2 below.

TABLE 2

| Fusing/ Surfacing Concept | Relative Humidity (%) at 75° F. 25% | 42% | 50% | 75% | 90% |
|---|---|---|---|---|---|
| Two-Stage Fuser/ Finisher | — | X* | X | X | no data |
| Two-Stage Fuser/ Finisher with Forced Hot Air Conditioner Means | — | — | X | X | no data |

*"X" indicates blistering

EXAMPLE 4

Copy sheets having unfused toner images of monocolor or multicolor prints were fed into apparatus which comprised a two-roller fuser, a conditioner means which included a heater and a fan for circulating heated air around the copy sheet, and a pair of heated surfacing rollers. High quality prints having a high surface luster were obtained when the apparatus was operated under the standard conditions shown in Table 3, and acceptable prints were obtained when the apparatus was operated within the operating range in Table 3.

TABLE 3

| Means | Two-Roller Fuser | Conditioner Means | Two-Roller Surfacing |
|---|---|---|---|
| Standard Operating Conditions | 300° F./ 300° F. 18 pli. 9"/sec. | 255° F. (Ambient) (0-15 sec. Delay) | 350° F./ 350° F. 40 pli 9"/sec. |
| Operating Range | 300°- 350° F. 18 pli 6-18"/sec. | 70° F.- 350° F. | 275°- 375° F. 10-40 pli 6-18"/sec. |

The invention has been described in detail with particular reference to the preferred embodiments thereof, but it will be understood that variations and modifications can be effected within the spirit and scope of the invention. For example, the invention is disclosed in the preferred embodiment as having the conditioner means 18 located between the fuser means 14 and the surfacing means 20; however, the conditioner means 18 could be located before the fuser means 14 in the paper path to remove moisture from the paper before it enters the fuser means 14.

What is claimed is:

1. A method of fixing a toner image on a copy sheet, said method comprising the steps of:

(a) fixing a toner image to copy sheets moveable along a copy sheet path; and (b) removing from about 50% to about 80% of the moisture content of a copy sheet bearing a toner image; and (c) passing said copy sheet through surfacing means to provide a gloss to the toner image, said surfacing means following said fuser means and said conditioner means along said copy sheet path.

2. A method as defined in claim 1 wherein about 20% to about 30% of said moisture is removed by passing the copy sheet through conditioner means in which the ambient temperature is above room temperature.

3. Apparatus for fixing toner images to copy sheets moveable along a copy sheet path, said apparatus comprising:

fuser means along the copy sheet path for fixing a toner image on a copy sheet;

conditioner means along the copy sheet path for removing moisture from said copy sheet; and surfacing means for providing a gloss to a toner image fixed on a copy sheet said surfacing means following said fuser means and said conditioner means along said copy sheet path.

4. Apparatus as defined in claim 3 wherein said conditioner means comprises means for supporting a copy sheet as it moves along said copy sheet path from said fuser means to said surfacing means, and means for heating the air surrounding said supporting means.

5. Apparatus as defined in claim 4 wherein said means for supporting a copy sheet includes a conveyor.

6. Apparatus as defined in claim 3 wherein said conditioner means is adapted to reduce the moisture content of a copy sheet to within about 20% to about 30% of the moisture content thereof prior to having an image fixed thereon.

7. Apparatus as defined in claim 3 wherein said fuser means comprises a pair of fuser rollers at least one of which has a generally conformable outer surface, and a heat source.

8. Apparatus as defined in claim 3 wherein said surfacing means comprises a pair of surfacing rollers, at least one of which has a generally nonconformable outer surface.

9. Apparatus as defined in claim 8 wherein said fuser means comprises a pair of fuser rollers, and said surfacing rollers are larger in diameter than said fuser rollers.

10. Apparatus for fixing toner images to copy sheets, moveable along a copy sheet path said apparatus comprising:

a pair of fuser rollers along the copy sheet path having a heat source associated therewith;

a conditioner means along the copy sheet path for removing moisture from said copy sheet, said conditioner means including a source of hot air; and a pair of surfacing rollers having a heat source associated therewith said surfacing rollers following said fuser rollers and said conditioner means along said copy sheet path.

11. Apparatus as defined in claim 10 wherein said fuser rollers are operated between about 300° and about 350° F., said hot air is from about 70° F. to about 350° F., and said surfacing rollers are operated from about 275° F. to about 375° F.

12. Apparatus as defined in claim 10 wherein said fuser rollers are biased toward each other with a pressure of about 18 pounds per linear inch, and said surfacing rollers are biased toward each other with a pressure of between about 10 and about 40 pounds per linear inch.

13. Apparatus as defined in claim 10 wherein said copy sheet is advanced through said apparatus at a speed of between about 6 and about 18 inches per second.

* * * * *